US008127777B2

(12) United States Patent
Gueret

(10) Patent No.: US 8,127,777 B2
(45) Date of Patent: Mar. 6, 2012

(54) APPLICATOR FOR APPLYING A SUBSTANCE

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 992 days.

(21) Appl. No.: 11/217,996

(22) Filed: Sep. 2, 2005

(65) Prior Publication Data

US 2006/0056903 A1 Mar. 16, 2006

Related U.S. Application Data

(60) Provisional application No. 60/610,945, filed on Sep. 20, 2004.

(30) Foreign Application Priority Data

Sep. 3, 2004 (FR) ..... 04 09374

(51) Int. Cl.
*A45D 40/26* (2006.01)

(52) U.S. Cl. ..... 132/218

(58) Field of Classification Search ..... 132/218, 132/317, 318, 320; 401/118, 126, 129
See application file for complete search history.

(56) References Cited

U.S. PATENT DOCUMENTS

| | | | |
|---|---|---|---|
| 4,586,520 | A | 5/1986 | Brittain |
| 4,804,004 | A | 2/1989 | Taylor |
| 4,898,193 | A | 2/1990 | Gueret |
| 5,542,439 | A | 8/1996 | Gueret |
| 6,328,495 | B1 | 12/2001 | Gueret |
| 6,343,607 | B1 | 2/2002 | Gueret |
| 6,412,496 | B1 | 7/2002 | Gueret |
| 6,655,390 | B2 | 12/2003 | Gueret |
| 6,681,777 | B2 | 1/2004 | Gueret |
| 7,334,584 | B2 | 2/2008 | Mathiez |
| 2003/0089379 | A1 | 5/2003 | Gueret |
| 2003/0213498 | A1 | 11/2003 | Gueret |
| 2004/0134507 | A1 | 7/2004 | Gueret |
| 2004/0240926 | A1 | 12/2004 | Gueret |
| 2004/0258453 | A1 | 12/2004 | Gueret |

FOREIGN PATENT DOCUMENTS

| | | | |
|---|---|---|---|
| EP | 1 046 358 | B1 | 10/2000 |
| EP | 1 070 466 | A2 | 1/2001 |
| EP | 1 169 941 | A1 | 1/2002 |
| EP | 1 306 029 | A1 | 5/2003 |
| EP | 1 342 428 | A1 | 9/2003 |
| EP | 1 459 647 | A1 | 9/2004 |

(Continued)

OTHER PUBLICATIONS

French Search Report for FR 04 09374, dated Feb. 9, 2005.

*Primary Examiner* — Rachel Steitz
(74) *Attorney, Agent, or Firm* — Finnegan, Henderson, Farabow, Garrett & Dunner LLP

(57) ABSTRACT

Various embodiments of a device for applying a substance to eyelashes and/or eyebrows may include a receptacle containing the substance and an applicator including an applicator member. In some examples, the applicator member may include a twisted support extending along a longitudinal axis and bristles held by the support. The applicator member may define at least one first longitudinally-extending region having a succession of notches configured to be loaded with the substance and at least one second longitudinally-extending region configured to separate eyelashes and/or eyebrows. In some exemplary embodiments, the first region may include at least five notches.

24 Claims, 8 Drawing Sheets

FOREIGN PATENT DOCUMENTS

| | | |
|---|---|---|
| FR | 2 715 038 | 7/1995 |
| FR | 2 831 032 A1 | 4/2003 |
| FR | 2 847 436 | 5/2004 |
| FR | 2 855 380 | 12/2004 |
| JP | 2003-259914 | 9/2003 |
| JP | 2004-174267 | 6/2004 |
| WO | WO 02/07562 A1 | 1/2002 |

APPLICATOR FOR APPLYING A SUBSTANCE

This application claims the benefit of priority under 35 U.S.C. §119(e) of U.S. Provisional Application No. 60/610,945, filed on Sep. 20, 2004.

The present invention relates to applicators for applying a substance. In particular, various exemplary embodiments of the present invention relate to applicators for applying a cosmetic product to keratinous fibers (e.g., eyelashes and/or eyebrows). The term "cosmetic product" includes makeup products as well as care products.

There are various applicator devices for applying a substance. For example, International Application Publication No. WO 02/07562 discloses a brush comprising a twisted core and bristles configured for cleaning dental interstices.

There are applicators comprising projecting elements that are made integrally with a support. Such applicators, sometimes also known as "combs," may have a plurality of rows of projecting elements.

U.S. Pat. No. 6,343,607 discloses an applicator comprising an applicator member. The applicator member may include a support having a polygonal cross section and a plurality of projecting elements disposed on the support, such that at least two projecting elements may extend away from the support substantially in continuation of two different sides of the support.

With such an applicator, when the axial spacing between the projecting elements is relatively small, only a limited quantity of substance may be deposited onto the eyelashes or eyebrows, resulting in an insufficient makeup effect. On the other hand, if the spacing between the projecting elements is too big, an excessive quantity of substance may be deposited onto the eyelashes, potentially causing, for example, hairs in the eyelashes or eyebrows to stick together.

European Application Publication No. EP 1 342 428 discloses a makeup applicator enabling some of the eyelash or eyebrow hairs to be grouped together in packets.

U.S. Pat. Nos. 4,586,520 and 4,898,193 relate to twisted mascara brushes having rows of bristles without any notches.

European Application Publication No. EP 1 306 029 discloses an applicator member having two rows of projecting elements. Each of the rows may be connected to each side of a support having a longitudinal axis that is curvilinear. Such an applicator may enable one row of projection elements to apply substance to the eyelashes, while the other row of projecting elements may be used to apply substance to the eyebrows.

U.S. Pat. No. 6,681,777 discloses an applicator member comprising a support, a mounting member pivotably coupled to the support, and a plurality of rows of bristles carried by the mounting member.

Thus, there exists a need for further improving the performance of at least some of the applicators for applying substance to keratinous fibers. For example, there exists a need to further improve the makeup effects, especially during a heavy makeup application, and to do so relatively easily without the hairs of eyelashes and/or eyebrows sticking together.

There also exists a need to enable a user to easily choose between a heavy makeup application and a less heavy makeup application.

Although the present invention may obviate one or more of the above-mentioned needs, it should be understood that some aspects of the invention might not necessarily obviate one or more of those needs.

In the following description, certain aspects and embodiments will become evident. It should be understood that the invention, in its broadest sense, could be practiced without having one or more features of these aspects and embodiments. It should be understood that these aspects and embodiments are merely exemplary.

In one exemplary aspect, as embodied and broadly described herein, the invention may provide an applicator for applying a substance to, for example, eyelashes and/or eyebrows. The applicator may comprise an applicator member comprising a support having a longitudinal axis, a first row of projecting elements extending along the support, and a second row of projecting element extending along the support. At least one of the projecting elements may extend in a direction different from a direction in which at least another of the projecting elements may extend. A radial angular spacing about the longitudinal axis of the support between the first row of projecting elements and the second row of projecting elements may be greater than zero and less than or equal to about 135°.

The projecting elements of the first row or groups of the projecting elements of the two rows may be distributed in a uniform manner along said first row. When said elements are part of an integral, single piece defining at least a portion of the support, the projecting elements or groups of the projecting elements of the first and second rows may be distributed differently such that at least three consecutive projecting elements or groups of projecting elements of the first row may have a first spacing from each other, and at least three consecutive projecting elements or groups of projecting elements of the second row may have a second spacing from each other, the second spacing being different from the first spacing.

In some exemplary aspects, at least one of the first and second rows of projecting elements may project from the remainder of the applicator member. In one aspect, the rows of projecting elements may be disjoint from one another. Moreover, the applicator member may include at least one longitudinal groove between two adjacent rows of projecting elements.

In various exemplary aspects, the projecting elements may be bristles or teeth. For example, the groups of projecting elements may be groups of teeth or tufts of bristles.

In some exemplary aspects, when the projecting elements are bristles, the support may comprise a twisted core. On the other hand, when the projecting elements are teeth, the projecting elements may be part of an integral, single piece (e.g., molded piece) defining at least a portion of the support (e.g., the entire support) by, for example, machining or stamping.

The term "angular spacing," as used throughout the description, including the claims, refers to a radial angle between two adjacent rows of projecting elements about the longitudinal axis of the support, where the angle is being measured from the midplanes of each row.

According to another aspect, a spacing between two consecutive projecting elements of the first row may differ from a spacing between two consecutive projecting elements of the second row.

An example of uniformly distributed projecting elements or groups of projecting elements within a row may include a plurality of projecting elements (e.g., teeth) or groups of projecting elements having their bases regularly spaced apart from each other along the row. In various exemplary aspects, when a first row has such uniformly distributed projecting elements or groups of projecting elements, a second row (e.g., adjacent to the first row) may also have uniformly distributed projecting elements or groups of projecting elements, but with a spacing that may be different from that of the first row (e.g., greater or less than the spacing of the first row). This configuration may enable an applicator member to accumulate a larger amount of substance between the first and second rows.

According to an aspect, groups of projecting elements may be uniformly distributed within a row with a regular spacing therebetween. Within each group of projecting elements, the projecting elements may extend in different directions from one another. Additionally or alternatively, the bases of the projecting elements in each group may be superposed at least partially on an axial plane when the applicator element is observed in a direction substantially perpendicular to its longitudinal axis. By way of example only, each group of projecting elements may comprise two or three projecting elements.

When the applicator member is a brush, in one aspect, the uniformly distributed bristles in a first row may not include any notch within the row, resulting in having denser bristles. Such a row having dense bristles may be more effective in separating hairs of eyelashes or eyebrows. In another aspect, the applicator member may include a second row of bristles (e.g., adjacent the first row) configured to be loaded with more substance than the first row.

In accordance with an aspect of the invention, since the radial angular spacing about the longitudinal axis of the support between the first and second rows is greater than zero and less than or equal to about 135°, by a simple wrist movement, a user may easily select a particular row of projecting elements to be brought into contact with eyelashes or eyebrows.

For example, a user may bring eyelashes or eyebrows into contact with a first row that is relatively heavily loaded with substance and then subsequently into contact with a second row to separate hairs of eyelashes or eyebrows. Alternatively, the user may bring eyelashes or eyebrows into contact with only one of the first and second rows, depending on whether a heavy or light make-up effect is desired.

Another aspect of the invention may provide an applicator for applying a substance to eyelashes or eyebrows, comprising an applicator member. The applicator member may comprise a support and at least two rows of projecting elements extending along the support. The projecting elements may be configured to be placed into contact with eyelashes and/or eyebrows. At least one of the projecting elements may extend in a direction different from a direction in which another of the projecting elements may extend. In some exemplary aspects, the at least two rows of projecting elements may be separated radially from one another about a longitudinal axis of the support by less than 135°. In still another exemplary aspect, the number of projecting elements or groups of projecting elements in one of the rows may range from about one-fourth to about three-fourths the number of projecting elements in another of the rows. More preferably, the number of projecting elements or groups of projecting elements in one of the rows may range from about one-third to about two-thirds the number of projecting element in another of the rows.

By way of examples only, the at least two rows of projecting elements may be separated radially from one another about a longitudinal axis of the support by less than 140°, 135°, 130°, 125°, 120°, 110°, or even 90°, depending on, for example, the number of rows in a given support.

In various aspects, the substance may comprise a mascara.

According to another exemplary aspect, the invention may provide a device for applying (and/or packaging) a substance to eyelashes and/or eyebrows. The device may comprise a receptacle containing the substance and an applicator comprising an applicator member. The applicator member may comprise a twisted support extending along a longitudinal axis and bristles held by the twisted support. In some aspects, the applicator member may define at least one first longitudinally-extending region comprising a succession of notches configured to be loaded with the substance and at least one second longitudinally-extending region configured to separate eyelashes or eyebrows. According to another aspect, the first region may comprise at least five notches.

In an aspect, the first and second longitudinally-extending regions formed of two disjoint rows of bristles. For example, the first and second longitudinally-extending regions may be separated by a groove that may extend at least partially along the longitudinal axis of the support. Alternatively, the first and second longitudinally-extending regions may not be separated by a groove.

In still another aspect, the device may comprise a wiper member. The wiper member may comprise a flexible wiper lip and/or a through-hole configured to wipe excessive amount of substance loaded onto the applicator member. In an exemplary embodiment, the wiper member may comprise a waved lip.

According to some aspects, the wiper may be configured such that, during wiping, the wiper does not wipe all the substance loaded in the notches, thus allowing a relatively large amount of substance to remain, after wiping, on the applicator member for applying a relatively heavier makeup. For example, the wiper may not extend to reach the bottom of the notches when the applicator member passes through the wiper member. Alternatively or additionally, the bristles of the applicator member may be sufficiently rigid so that the substance loaded in the notches may not be wiped by the wiper member.

In an aspect, the applicator member may comprise a left-twisted support, such as, for example, a twisted wire core as disclosed in U.S. Pat. No. 6,345,923.

According to one aspect, the applicator member may define an envelope surface (e.g., a surface defined by ends of at least some bristles and/or teeth that are positioned furthest away from an axis of the applicator member) comprising a shape that may generally taper towards a distal end of the applicator member. Alternatively or additionally, the applicator member may define an envelope surface having a minimum cross-sectional area between ends of the support. In some exemplary embodiments, the envelope surface may have more than one portion that defines the minimum cross-sectional area between ends of the support.

In another aspect, the applicator member may define an envelope surface having a circular cross-section along at least a fraction of a length of the applicator member. By way of example only, the envelope surface of the applicator member may comprise a cylindroconic shape.

In still another exemplary aspect, the applicator member may have an envelope surface having a polygonal cross-section along at least a fraction of a length of the applicator member. For example, the applicator member may have an envelope surface having a substantially square cross-section along at least a fraction of a length of the applicator member.

According to another aspect, the applicator member may have a substantially star-shaped cross-section having at least three branches (e.g., inscribed within the envelope surface). For example, the applicator member may have a substantially cross-shaped cross-section having four branches. In still another aspect, at least one of the rows corresponding to one of the branches may include notches, and at least one another row may not include any notches.

In an aspect, the notches of the succession of notches may be spaced regularly apart. In another aspect, at least one of the notches may comprise a substantially flat bottom. In still another aspect, at least one of the notches may extend over a length along the longitudinal axis of the support, and the length may be less than 3 mm.

According to various exemplary aspects, the bristles may comprise at least two rows of bristles, and one of the at least two rows of bristles may comprise notches In an exemplary aspect, the at least two rows may define a groove therebetween. The groove may extend along the longitudinal axis of the support and present an angular width of less than 135°.

According to some exemplary aspects, when the applicator member includes a plurality of first longitudinally-extending regions comprising a succession of notches, the notches in one of the plurality of first longitudinally-extending regions may occupy substantially the same axial positions as those in another of the plurality of first longitudinally-extending regions.

In another aspect, the applicator member may comprise two first longitudinally-extending regions extending over more than half the length of the portion of the support carrying the bristles and two second longitudinally-extending regions lacking any notches. Each of the two second longitudinally-extending regions may be disposed between the two first longitudinally-extending regions.

According to still another aspect, the angular width of the second longitudinally-extending region, as measured about the longitudinal axis of the support, may be, for example, greater than or equal to about 30°, 40°, or 50°.

In one aspect, the notches may be formed in the applicator member by, for example, truncating (e.g., cutting) the cross-section of the envelope surface.

For example, to make the notches, the applicator member may be brought into contact with teeth of a rotating wheel whose width may correspond to the desired width of the notches. In some exemplary embodiments, the width of the teeth and/or the notches may range from about 1 mm to about 4 mm, preferably from about 1.5 mm to about 3.5 mm, and more preferably from about 2 mm to about 3 mm. By way of example only, the width of the teeth and/or the notches may be about 2.5 mm. The width between two teeth may be, for example, equal to the width of a tooth.

In some exemplary aspects, at least one of the notches may comprise a substantially flat bottom. At least one of the notches may extend over a length along the longitudinal axis of the support. The length may be less than 3 mm.

In another aspect, a succession of notches may comprise at least 6, 7, 8, 9, or 10 notches.

In still another aspect, the notches of the succession of notches may be spaced regularly apart. For example, the notches or group of notches may be arranged periodically with a constant spacing apart from each other.

After the notches are formed on one side of the applicator member, the applicator member may be optionally turned (e.g., 180°) to make notches on another side (e.g., the opposite side) of the applicator member.

The rotating wheel may be configured to cut the bristles down to the twisted support. In an exemplary embodiment, the bristles may be cut at least half or about two third of their length. Thus, the profile of the applicator member may comprise slots when observed in a direction perpendicular to the longitudinal axis of the twisted support.

By way of example only, the outer diameter of the applicator member may range from about 3.5 mm to about 9 mm. The bristles may have a diameter ranging from, for example, about 150 to about 350 μm. The bristles may be either full or hollow. The applicator member may comprise, for example, about 25 to 50 bristles per 180° turn around the support.

In another aspect, the second region may not comprise any notch. In still another aspect, the projecting elements (e.g., bristles) of the applicator member may be arranged in a non-helicoidal configuration along the longitudinal axis of the support. This arrangement may substantially eliminate or reduce a significant whirl effect that may otherwise result when the free ends of the bristles are arranged in a helicoidal configuration.

According another aspect, independently or in combination with the above exemplary aspects, the invention may provide an applicator for applying a substance to eyelashes and/or eyebrows having an applicator member. The applicator may comprise a support (e.g., a twisted support) extending along a longitudinal axis and at least first and second rows of bristles supported by the support. The first row may include a plurality of notches. The second row may include a smaller number of notches than that of the first row. In some exemplary embodiments, the second row may not have any notches.

The greater the number of notches is in a given row, the greater the quantity of substance the row can be loaded therewith. Thus, the rows may be arranged in such a manner that, depending on which row a user intends to bring into contact with eyelashes or eyebrows, the user may be able to apply a desirable amount of substance on eyelashes or eyelashes or, on the contrary, to remove substance therefrom. Of course, the row that is more lightly loaded with substance may also be used for separating eyelashes or eyebrows.

In another aspect, the support may comprise a bristle-carrying portion. At least one of the rows may extend over more than about half the length of the bristle-carrying portion of the support.

According to still another aspect, the maximum lengths of the bristles in at least two of the rows may be substantially equal. Alternatively, they may be different. Thus, the rows may present dimensions that are unequal.

In some exemplary aspects, at least one of the notches may comprise a substantially V-shaped or U-shaped profile when the brush (e.g., row including the notches) is observed from the side in a direction substantially perpendicular to the longitudinal axis of the support.

According to another exemplary aspect, the depths of the notches may be substantially equal to the lengths of the bristles disposed on either side of the notches within the corresponding row. In still another aspect, two adjacent rows of bristles may have different numbers of notches.

The spacing between two successive notches in a row may be different from the pitch of the twisted support of the applicator member. For example, the spacing may be an integer multiple of the pitch of the twisted support.

A notch may define a cross-sectional shape that is substantially constant at least partially in the direction of the longitudinal axis of the support. For example, the entire notch may define a cross-sectional shape that is substantially constant in the direction of the longitudinal axis of the support.

At least one notch may define at least one radial face that is arranged substantially circumferentially with respect to the longitudinal axis of the support. For example, at least one notch may define two radial faces (e.g., facing each other) circumferentially arranged with respect to the longitudinal axis of the support.

In some exemplary aspects, the angular extent of a notch in a sectional plane extending across the support (e.g., twisted core) may be less than 360°. For example, the angular extent may be less than 180° or 120°.

In another aspect, the angular extent over which a notch may extend about the axis of the applicator member may range from about 20° to about 180°. Preferably, the angular extent may range from about 40° to about 50° or from about 110° to about 130°. In an exemplary aspect, the angular extent of a notch over the circumferential direction may be greater than that over its axial direction along the longitudinal axis of the support.

In various exemplary aspects, a notch may extend along the longitudinal axis of the applicator member over a length ranging from about 1.5 mm to about 6.5 mm. For example, the length may be greater than about 2.5 mm. By way of example only, the notch may have a maximum depth in the direction substantially perpendicular to the longitudinal axis of the support ranging from about 2.5 mm to about 4 mm.

According to another aspect, a notch may extend over less than four-tenths of the length of the portion of the applicator member carrying the bristles. For example, a notch may extend over less than three-tenths of said length.

In still another aspect, the applicator member may comprise at least two rows of bristles. The at least two rows of bristles may comprise a first row of bristles comprising notches and a second row of bristles positioned adjacent the first row of bristles and lacking any notches. The at least two rows of bristles may be disjoint from one another. For example, the at least two rows of bristles may comprise a plurality of first rows and a plurality of second rows arranged so that one of the first rows may alternate with one of the second rows.

Some exemplary aspects may provide at least one longitudinal groove between the at least two adjacent rows of the bristles, separating the at least two adjacent rows of bristles from one another. In an exemplary aspect, the at least one groove may extend in the longitudinal direction of the support over the entire bristle-carrying portion of the applicator member.

In one aspect, the applicator may include an alternation of rows having no notches and rows each having a plurality of notches. For example, the at least two rows of bristles may comprise a plurality of first rows and a plurality of second rows arranged so that one of the first rows may alternate with one of the second rows.

In an exemplary aspect, at least one of the at least two rows of bristles may comprise a width that is substantially constant over at least a fraction of its length when the applicator is observed along the longitudinal axis of the support. Alternatively or additionally, at least one of the at least two rows of bristles may comprise a width that varies (e.g., increases or decreases) in a radially outward direction extending away from the support when the applicator is observed along the longitudinal axis of the support.

According to another aspect, two adjacent rows of bristles may have unequal widths.

In some aspects, the longitudinal axis of the support may be rectilinear or curvilinear.

In one aspect, the applicator member may be configured such that a screw-thread effect may be substantially prevented or reduced. For example, the applicator member may comprise bristles that have been deformed (e.g., beaten) or bristles that are hollow.

In another aspect, independently or in combination with any of the exemplary aspects discussed above, the invention may provide an applicator for applying a substance to eyelashes and/or eyebrows, comprising an applicator member (e.g., a brush). The applicator member may comprise a twisted support extending along a longitudinal axis and bristles supported by the twisted support. The bristles may comprise a first longitudinally extending row of bristles and a second longitudinally extending row of bristles. Each of the first and second rows may comprise a plurality of notches distributed therealong. The notches of the first row may be positioned at different axial positions along the support, and the axial positions of the notches of the first row may coincide at least partially with axial positions of the notches of the second row. The applicator member may comprise at least one region located between the first and second rows and lacking any notch.

In various aspects, the at least one region may comprise at least one longitudinally extending row of bristles In one aspect, the first longitudinally extending row of bristles may comprise more than five notches.

In another aspect, the notches in one row may present bottoms that may be parallel to the bottoms of the notches of the other row.

Some exemplary aspects of the invention may provide an applicator for applying a substance to eyelashes and/or eyebrows, comprising an applicator member (e.g., a brush). The applicator member may comprise a twisted support extending along a longitudinal axis and bristles supported by the twisted support. The bristles may comprise bristles having a cross-section other than a solid circular cross-section and/or bristles that have been deformed (e.g., beaten). The applicator member may comprise at least one longitudinal region having a succession of notches.

In another exemplary aspect, the succession of notches may comprise, for example, more than five notches. In still another aspect, the notches may be spaced regularly.

Such an applicator, in particular a brush, may present little or no screw-thread effect, and the presence of the notches may make it possible to benefit from a region that may be used for loading more substance onto eyelashes or eyebrows.

In an aspect, the longitudinal region provided with notches may optionally be formed by a row situated between two longitudinal grooves.

According to another aspect, the invention may provide an applicator for applying a substance to eyelashes and/or eyebrows, comprising an applicator member. The applicator member may comprise a support having a longitudinal axis and at least first, second, and third rows of projecting elements integral with at least a portion of the support (e.g., as a single piece). At least the first and second rows each having at least three consecutive projecting elements or groups of projecting elements. The three consecutive projecting elements or groups of projecting elements of the first row may be regularly spaced apart from each other by a first spacing, and the three consecutive projecting elements or groups of projecting elements of the second row may be regularly spaced apart from each other by a second spacing, different from the first spacing.

The projecting elements or groups of projecting elements that may be spaced apart with a larger spacing may enable a relatively large quantity of substance to be applied to eyelashes or eyebrows and to obtain a relatively heavy makeup effect. In addition; the projecting elements or groups of projecting elements spaced apart with a smaller spacing may be advantageously used for separating and/or combing the eyelashes or eyebrows or for obtaining a less heavy makeup effect.

In some exemplary aspects, the presence of projecting elements or groups of projecting elements having different spacings on a single applicator member may make it possible to obtain a balanced makeup effect, with the eyelashes or eyebrow hairs being coated with substance without being stuck together.

According to another aspect, the second spacing may be a multiple of the first spacing. For example, the second spacing may be two or three times the first spacing. According to various exemplary aspects, the second spacing may range from about 1.5 to about 5 times the first spacing. Preferably, the second spacing may range from about 1.7 to about 4 times, or in particular from about 2 to about 3 times the first spacing.

In still another aspect, the first and second rows may be sufficiently close together to enable at least a fraction of their projecting elements to come into contact with eyelashes or eyebrows during a single makeup-application stroke.

According to some exemplary aspects, at least one projecting element of the first row may extend in a first direction, at least one projecting element in the second row may extend in a second direction, and the first and second directions may form between them an angle that is less than or equal to about 180°, 140°, 135°, 120°, 110°, or 90°. The majority or even all of the projecting elements of the first row may extend in the first direction, and the majority or even all of the projecting elements of the second row may extend along the second direction.

In one aspect, the applicator may have at least four rows of projecting elements. In particular, the applicator may have four to eight rows of projecting elements. These rows may be placed about the longitudinal axis of the support.

In another aspect, the first and second rows may extend substantially parallel to the longitudinal axis of the support.

In still another aspect, the support may have a cross-sectional shape that may be substantially oval, elliptical, circular, or polygonal. For example, the support may have a substantially triangular, square, pentagonal, hexagonal, heptagonal, or octagonal shape. The support may also have any other polygonal shape (e.g., regular or irregular) having more than eight sides.

In an aspect, at least one of the rows of projecting elements may extend substantially parallel to at least one of the faces of the support.

In another aspect, at least one of the rows of projecting elements may extend from the support substantially in a middle region of one of the faces thereof. The first and second rows of projecting elements may in particular extend from a common face of the support or from two respective faces that are adjacent to each other.

In still another aspect, at least one of the rows of projecting elements may extend, at least in part, substantially tangentially to the support. At least one of the rows of the projecting elements may extend substantially perpendicularly to the support (e.g., in a middle region of one of its faces).

According to another aspect, the applicator may have a single row of projecting elements in each corresponding face of the support.

In some exemplary aspects, the applicator member may have at least two alternating rows. One of the at least two alternating rows may have at least three consecutive projecting elements or groups of projecting elements that may be regularly spaced apart from each other by a first spacing, and another of the at least two alternating rows may have at least three consecutive projecting elements or groups of projecting elements that may be regularly spaced apart from each other by a second spacing, different from the first spacing.

By way of examples only, the support and the projecting elements may be made by molding, for example, by injection-molding a plastics material (e.g., a thermoplastic elastomer). For example, the plastic material may be selected from at least one of: polyolefins (e.g., polyethylene or polypropylene), polyamide, polyethylene terephthalate, polyoxymethylene, polystyrene, polycarbonate, Pebax®, styrene-ethylene/butylene-styrene (SEBS), polyurethane, nitrile, ethylene-propylene terpolymer rubber (EPDM), ethylene vinyl acetate (EVA), polyester, and Hytrel®.

In an aspect, the support and/or at least one of the projecting elements may comprise magnetic properties. For example, the applicator member may include a filler of magnetic particles (e.g., permanently magnetized and/or magnetizable material) dispersed in the material of the support and/or the projecting elements.

In another aspect, at least one row of projecting elements may comprise more than 20 projecting elements. For example, at least one row of projecting elements may comprise about 25 to 30 projecting elements.

In still another aspect, another row of projecting elements in the applicator member may comprise less than 25 or 20 projecting elements. For example, the other row of projecting elements may include about 15 projecting elements.

According to one aspect, the height of the projecting elements, as measured from the support, may range from about 0.5 mm to about 10 mm, and in particular from about 1 mm to about 4 mm.

According to another aspect, the projecting elements of the first row may have substantially the same height as the projecting elements of the second row. Alternatively, at least one projecting element of the first row may have a height that is different from that of a projecting element of the second row.

In another exemplary aspect, at least one projecting element of at least one row may have a substantially pyramid shape.

In still another aspect, at least two projecting elements in at least one row may form at least one V-shaped groove or notch when the applicator member is observed in a direction substantially perpendicular to the longitudinal axis of the support.

According to another aspect, the projecting elements of at least one row may have bases that are substantially in alignment with each other. Alternatively, the projecting elements of at least one row may be disposed at least in part on opposite sides of a geometrical separation plane that may substantially extend along the longitudinal axis of the support.

In some exemplary embodiments, the centers of the bases of the projecting elements of the first row may occupy substantially the same axial positions along the longitudinal axis of the support as those of the projecting elements of the second row. In a variant, the centers of the bases of the projecting elements of the first row may be situated axially between the centers of the bases of the projecting elements of the second row.

In an aspect, at least two consecutive projecting elements of the first row may be touching each other. At least two consecutive projecting elements of the second row may also be touching each other. In a variant, at least two consecutive projecting elements of the first row may not be touching each other, and/or at least two consecutive projecting elements of the second row may not be touching each other.

In some aspects, the longitudinal axis of the support may be rectilinear or curvilinear.

In another aspect, none of the projecting elements may be internally hollow. Alternatively, at least one of the projecting elements may be hollow.

According to various exemplary aspects, the applicator member may not have any bristles fitted to the support. For example, the applicator member may have teeth only. Alternatively, in one exemplary aspect, the applicator member may have some bristles fitted to the support.

According to another aspect, the invention may provide an applicator for applying a substance to eyelashes and/or eyebrows, comprising an applicator member. The applicator member may comprise a support having a longitudinal axis and at least first, second, and third rows of projecting elements extending from the support and being part of an integral, single piece defining at least a portion of the support. The number of projecting elements of the second row may range from about one-fourth to about three-fourths the number of projecting elements of the first row. In some exemplary aspects, the number of projecting elements may range from about one-third to about two-thirds the number of projecting elements in the first row. In another aspect, the projecting elements may not be parallel to a common direction.

In various aspects, the invention may provide an applicator for applying a substance to eyelashes and/or eyebrows, comprising an applicator member. The applicator member may comprise a support having a longitudinal axis and at least first and second rows of projecting elements extending from the support and being part of an integral, single piece defining at least a portion of the support. According to an exemplary aspect, the number of projecting elements of the second row may range from about one-fourth to about three-fourths the number of projecting elements of the second row and, in some particular aspects, from about one-third to about two-thirds. In another aspect, the first and second rows may be separated radially from one another about the longitudinal axis of the support by an angular spacing of less than 180°.

In still another aspect, the invention may provide an applicator for applying a substance to eyelashes and/or eyebrows, comprising an applicator member. The applicator member may comprise a support having a longitudinal axis and at least first, second, and third rows of projecting elements extending from the support and being part of an integral, single piece defining at least a portion of the support. At least the first and second rows may each have at least three consecutive projecting elements or groups of projecting elements. The consecutive projecting elements or groups of projecting elements of the first row and those of the second row may be spaced apart regularly from each other. The arrangement of the projecting elements of the first row may be different from the arrangement of the projecting elements of the second row.

Another aspect of the invention may provide an applicator for applying a substance to eyelashes and/or eyebrows, comprising an applicator member. The applicator member may comprise a support having a longitudinal axis and at least first, second, and third rows of projecting elements extending from the support and being part of an integral, single piece defining at least a portion of the support. The first and second rows of projecting elements may be substantially identical to each other and different from a third row. By way of example, the third row may be situated between the first and second rows that are substantially identical to each other.

According to one exemplary aspect, the applicator may comprise a stem extending along a longitudinal axis and having a first end connected to the applicator member.

In some exemplary aspects, the longitudinal axes of the stem may coincide with the longitudinal axis of the support. In a variant, the longitudinal axis of the stem and the longitudinal axis of the support may form a non-zero angle therebetween. The non-zero angle may be less than or equal to, for example, about 30°. Preferably, the non-zero angle may range from about 1° to about 20° and, in particular, from about 2° to about 10°.

According to another aspect, the stem may have a second end (e.g., opposite from the first end) connected to a handle member. In some exemplary aspects, the handle member may constitute a closure cap for a receptacle containing substance. In still another aspect, the closure cap may be configured to cooperate with the receptacle by screw fastening.

According to some aspects, the invention may provide a device for packaging and/or applying a substance. The device may comprise a receptacle containing the substance and any of the application members (e.g., a brush or comb) defined above.

The device may include a wiper member. The wiper member may be made of a material that is not cellular, for example.

In another aspect, the wiper may have at least one slot. For example, the wiper member may have a slot whose edges may be substantially joined at rest in the absence of the applicator member, as described in U.S. Pat. No. 6,328,495 (i.e., corresponding to European Application Publication No. EP 1 046 358 B1), the disclosure of which is incorporated herein by reference.

In another embodiment, the wiper member may have a longitudinally split annular portion having a wall including at least one slot extending to a free end of the wiper member. The slot may extend through the entire thickness of the wall, and the split portion may present, in a plane, where its inner cross section is at minimum, an outer cross-section that may be greater than the greatest cross-section of the applicator member. The split portion may deform radially outwardly when the applicator member passes therethrough. This exemplary embodiment of a wiper member is described in U.S. patent application Publication No. 2004/0258453 (i.e., corresponding to French Application Publication No. FR 2 855 380), the disclosure of which is incorporated herein by reference.

In another aspect, the wiper member may comprise at least one waved lip having a radially-extended inner free edge that may define the through-hole for the applicator member to pass through.

According to various aspects, the substance may comprise a makeup product (e.g., mascara) or a care product for eyelashes and/or eyebrows. However, the invention is, by no means, limited to cosmetic products for eyelashes and eyebrows. For example, the invention may be used to apply substance to any other parts of a body. Moreover, the invention may be used to apply substance other than cosmetic products, such as, for example, pharmaceutical products.

Some exemplary aspects of the invention may provide a method of applying a substance to, for example, eyelashes and/or eyebrows. The method may comprise: providing an applicator comprising at least two different regions having projecting elements (e.g., rows of projecting elements); loading the substance onto the projecting elements (e.g., bristles or teeth) of the applicator; moving the applicator (e.g., turning the applicator about its longitudinal axis) to bring the projecting elements into contact with the eyelashes or eyebrows. The applicator may be configured in such way that in a single application stroke, the projecting elements in one of the two regions and the projecting elements in another of the two regions may be simultaneously or successively brought into contact with the eyelashes or eyebrows.

In another aspect, moving the applicator may comprise turning the applicator about its longitudinal axis for less than or equal to about 140°, 135°, 130°, 125°, or 120°.

Aside from the structural and procedural arrangements set forth above, the invention could include a number of other arrangements, such as those explained hereinafter. It is to be understood that both the foregoing description and the following description are exemplary.

The accompanying drawings, which are incorporated in and constitute a part of this specification, illustrate a number of non-limiting embodiments of the invention and together with the description, serve to explain the principles of the invention.

Figure 33:
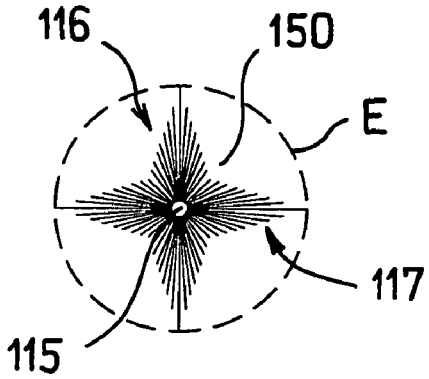
FIGS. 33 and 34 are diagrammatic, cross-sectional views of the applicator member shown in FIG. 32, according to various exemplary embodiments of the invention.
Figure 34:
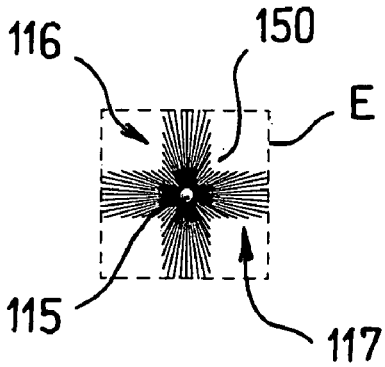
Figure 36:
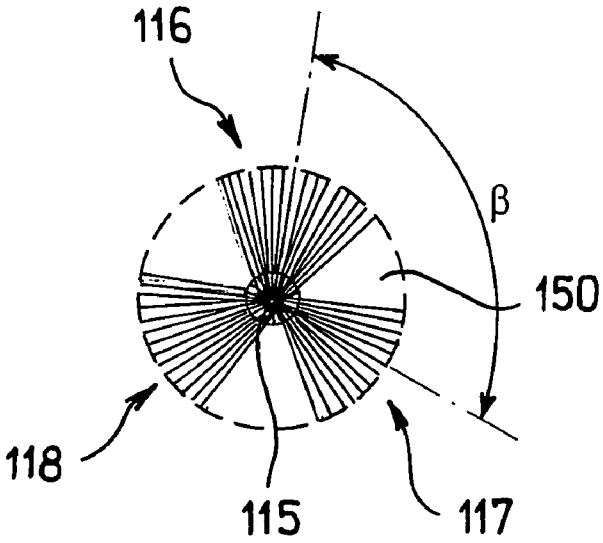
Figure 37:
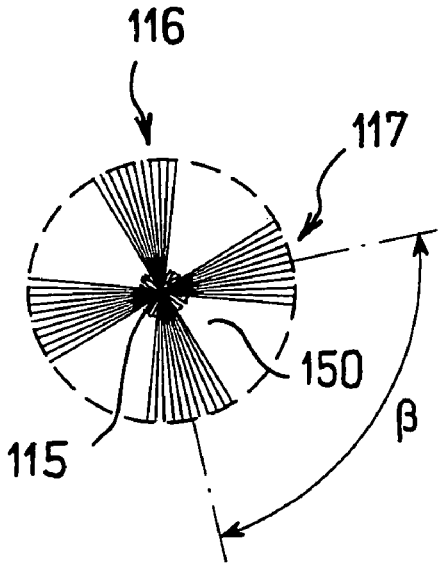
Figure 38:
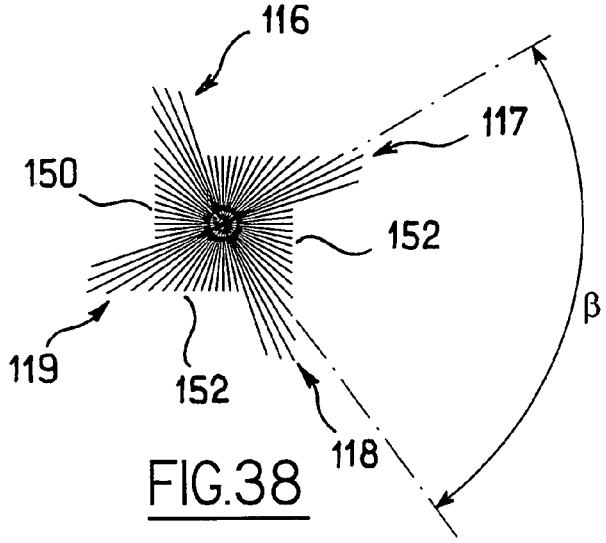

FIGS. 36, 37, and 38 are diagrammatic, cross-sectional views, analogous to FIGS. 33 and 34, according to various exemplary embodiments of the invention.

Figure 39:
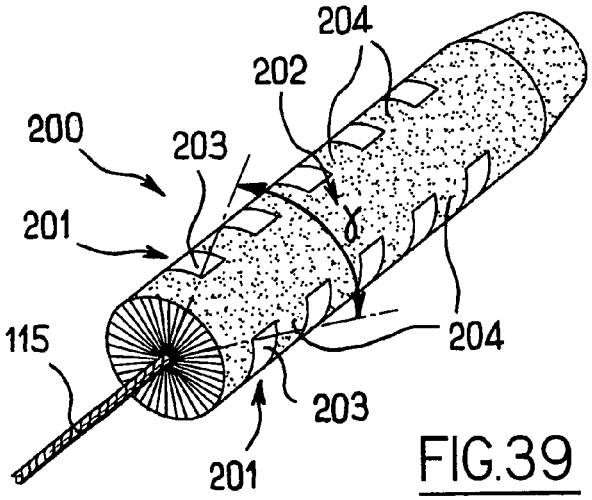

FIG. 39 is a diagrammatic, perspective view of an applicator member, according to still another exemplary embodiment of the invention.

Figure 40:
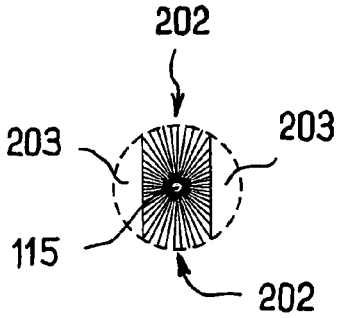
Figure 41:
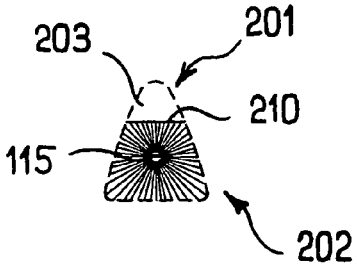
Figure 42:
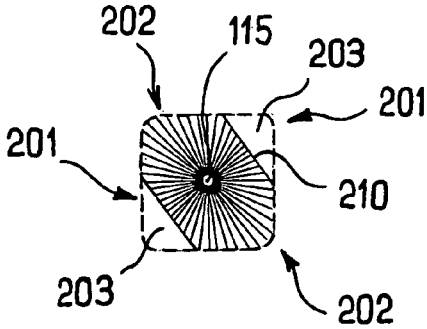

FIGS. 40 to 42 are diagrammatic, cross-sectional views of the applicator member shown in FIG. 39 along a plane containing the notches, according to various exemplary embodiments of the invention.

Reference will now be made in detail to the exemplary embodiments of the invention, examples of which are illustrated in the accompanying drawings. Wherever possible, the same reference numbers will be used throughout the drawings to refer to the same or like parts. It is to be understood that both the foregoing general description and the following detailed description are exemplary and explanatory only and are not restrictive of the invention, as claimed.

Figure 1:
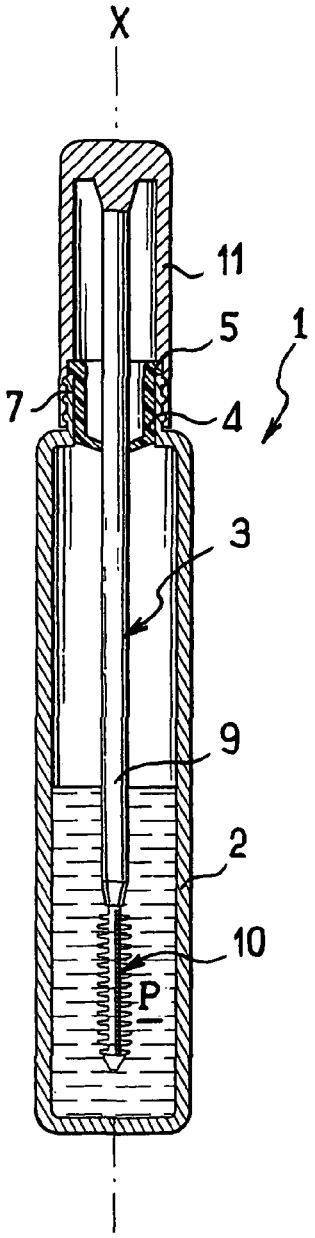
FIG. 1 is a diagrammatic, axial cross-sectional view of a packaging and applicator device, according to an exemplary embodiment of the invention.

FIG. 1 shows a packaging and applicator device 1 for applying a substance P to, for example, keratinous fibers (e.g., eyelashes or eyebrows), according to an exemplary embodiment of the invention. The device may comprise a receptacle 2 having a neck 7, an applicator 3 (e.g., comb), and a wiper member 4. The wiper member 4 may include a collar 5 that may press against the neck 7.

By way of example, the substance P may be a cosmetic product (e.g., mascara) or a care product.

The applicator 3 may comprise a stem 9 having a longitudinal axis X, which may be provided at a first end with an applicator member 10 and at a second end with a handle member 11. The handle member 11 may also constitute a closure cap for the receptacle 2. In the exemplary embodiment shown in FIG. 1, the cap 11 may have a thread on its inside surface for screwing onto an outside thread of the neck 7 of the receptacle 2.

Figure 2:
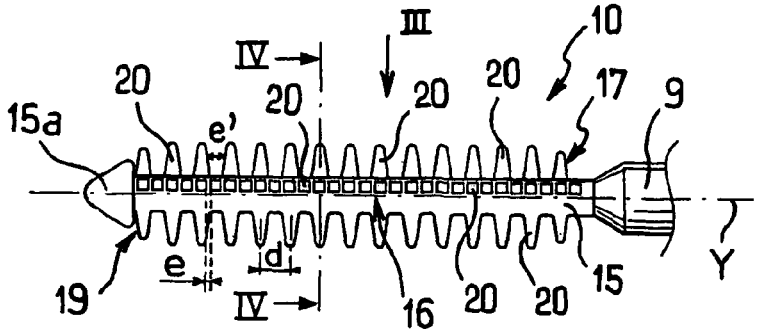
FIG. 2 is a partial, diagrammatic side view of the device shown in FIG. 1, illustrating an exemplary embodiment of an applicator member.
Figure 3:
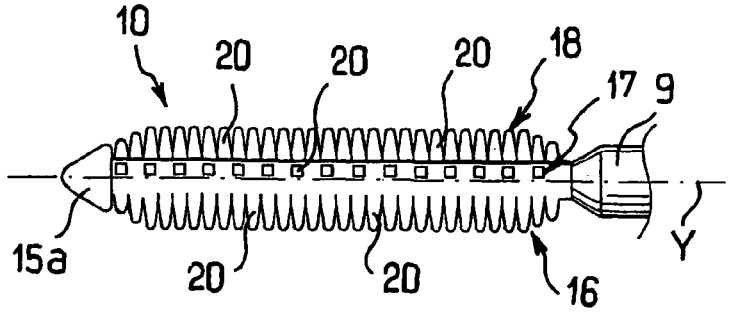
FIG. 3 is a fragmentary plan view of the applicator member shown in FIG. 2, as seen in the direction of arrow III.
Figure 4:
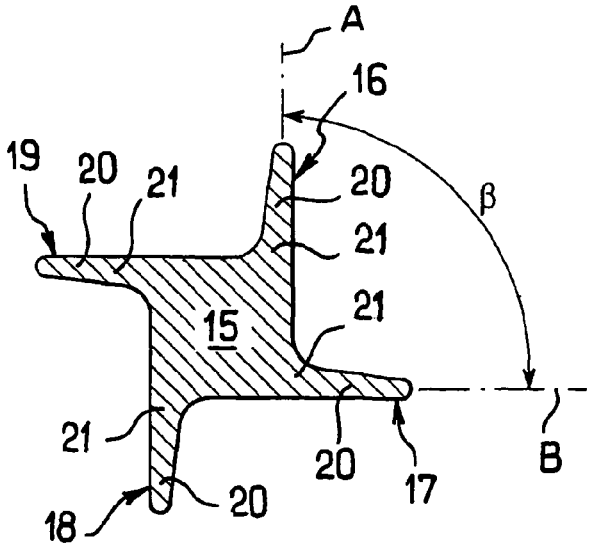
FIG. 4 is a diagrammatic, cross-sectional view of the applicator member shown in FIG. 2 along the IV-IV plane.

The applicator member 10, shown in detail in FIGS. 2 to 4, may comprise a support 15 having a longitudinal axis Y that may be rectilinear. A plurality of rows 16, 17, 18, 19 of projecting elements 20 (e.g., teeth) may be connected to the support 15. Each row of projecting elements 20 may extend substantially parallel to the longitudinal axis Y of the support 15.

In the exemplary embodiment shown in FIGS. 2 and 3, the applicator member 10 has four rows of projecting elements 20: first row 16, second row 17, third row 18, and fourth row 19. The first and third rows 16, 18 may be identical, and may be positioned opposite from each other symmetrically with respect to the support 15. The same may apply to the second and fourth rows 17, 19.

The support 15 may include a tapering distal portion 15*a* for making it easier for the applicator member 10 to pass through the wiper member 4, in particular when the applicator member 10 is being inserted into the receptacle 2.

Each of the rows 16, 17, 18, 19 may have at least three consecutive projecting elements 20 that may be regularly spaced apart from each other. For example, as shown in FIG. 2, the projecting elements 20 of the first row 16 may have a first spacing e between two consecutive projecting elements 20, and the projecting elements 20 of the second row 17 may have a second spacing e', different from the first spacing e.

Figure 5:
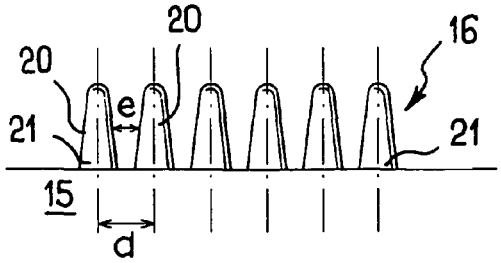
FIGS. 5 and 6 are partial, plan views of an applicator member, according to an exemplary embodiment of the invention, illustrating consecutive projecting elements in two different rows of the applicator member.

Unless otherwise defined, the term "spacing between two consecutive projecting elements" in a given row is used to designate the distance between the outside surfaces of two consecutive projecting elements, as shown in FIG. 5, where the distance is measured substantially halfway up the projecting elements 20 starting from the support 15. The spacing e between two consecutive projecting elements 20 may therefore be different from the spacing d between the axes of the projecting elements 20.

In the exemplary embodiment shown in FIGS. 1 to 4, while the projecting elements 20 in the first and second rows 16, 17 may be identical to each other, the spacing between the axes of the projecting elements 20 of the second row 17 may be substantially equal to twice the spacing between the axes of the projecting elements 20 of the first row 16.

Figure 6:
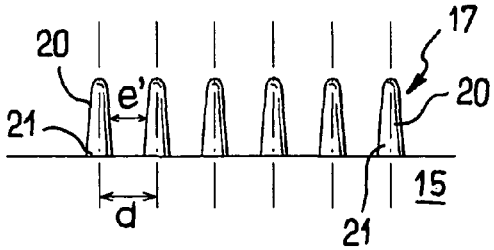

In an alternative embodiment, the spacing between the axes of the projecting elements 20 in the first row 16 (i.e., spacing between the centers of the bases 21 in the first row 16) may be identical to the spacing between the axes of the projecting elements 20 in the second row 17. Yet, the spacing between two consecutive projecting elements 20 in the first row 16 may be different from the spacing between two consecutive projecting elements 20 in the second row 17. The difference in spacing may be due to the difference in the widths of the projecting elements 20 of the first and second rows 16, 17. For example, as shown in FIGS. 5 and 6, the projecting elements 20 of the first row 16 may define a spacing e that is smaller than the spacing e' between the finer projecting elements 20 of the second row 17. The spacing d between the centers of the bases 21 of the projecting elements 20 may be the same in both the first and second rows 16, 17.

The centers of the bases 21 of the projecting elements 20 of the first row 16 may occupy substantially the same axial positions along the longitudinal axis Y of the support 15 as those of the projecting elements 20 of the second row 17.

When the number of projecting elements 20 in the first and second rows 16 and 17 is not substantially the same, as shown in the exemplary embodiment of FIGS. 1 to 4, the second spacing e' between the projecting elements 20 of the second row 17 may be multiple of the first spacing e between the projecting elements 20 of the first row 16. For example, the ratio between the first spacing e' and the second spacing e (i.e., e'/e) may range from about 1.5 to about 5. Preferably, the ratio may be about 2, as shown in the exemplary embodiment shown in FIGS. 1 to 4.

As best shown in FIG. 3, the third row 18 of projecting elements 20 may be identical to the first row 16 of projecting elements 20 and may be situated opposite the first row 16 in substantial symmetry with respect to a midplane of the applicator member 10 containing the longitudinal axis of the applicator member 10.

In some exemplary embodiments, the third row 18 may not be identical to the first row 16. Instead, the third row 18 may be identical to the second row 17. In some exemplary embodiments, the third row 18 may be different from both the first row 16 and the second row 17. For example, the spacing between the projecting elements 20 of the third row 18 may be different from the first spacing e or the second spacing e'. For example, the spacing between the projecting elements 20 of the third row 18 may be between the first and second spacings e and e', less than e, or greater than e'.

The first and second rows 16, 17 of projecting elements 20 may be arranged in close vicinity to one another so that they may come into contact with eyelashes or eyebrows in a single application stroke.

With particular reference to FIG. 4, the projecting elements 20 of the first row 16 may extend in a first direction A and the projecting elements 20 of the second row 17 may extend in a second direction B. The first direction A and the second direction B may form between them an angle β of about 90°, corresponding to the angular separation between the two rows 16, 17 of projecting elements 20.

Naturally, the angle β between the first and second directions A, B is not limited to about 90°. For example, the angle β may be less than about 90° or may range from about 90° to about 180°. In some exemplary embodiments, the angle β may range from about 120° to about 180°. By way of examples only, the angle β may be less than about 140° or about 135°.

The applicator member 10 may have greater or less than four rows of projecting elements. For example, the applicator member 10 may have three to eight rows of projecting elements. In some exemplary embodiments, the applicator member 10 may have more than eight rows of projecting elements.

In the exemplary embodiment shown in FIGS. 1 to 4, the cross-sectional shape of the support 15 may be substantially square having four faces, and each row 16, 17, 18, 19 of projecting elements 20 may extend in a direction substantially parallel to the corresponding face of the support 15. As best shown in FIG. 4, the projecting elements 20 in each row 16, 17, 18, 19 may extend in a direction substantially perpendicular to the corresponding face of the support 15 and substantially parallel to the adjacent face of the support 15. Thus, the support may have a single row of projecting elements 20 associated with a corresponding face of the support 15. The rows 16, 17, 18, 19 of projecting elements 20 may extend in the same clockwise or counter-clockwise direction.

The configuration of the applicator member 10 is not limited to the exemplary embodiments described above with reference to FIGS. 1 to 4. As will be described further herein with reference to FIGS. 7 to 18, the applicator member 10 may have various alternative configurations.

Figure 7:
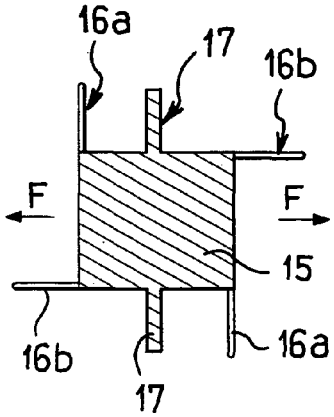
FIGS. 7 to 18 are diagrammatic, cross-sectional views of an applicator member, analogous to FIG. 4, illustrating various exemplary embodiments of the applicator member.
Figure 10:
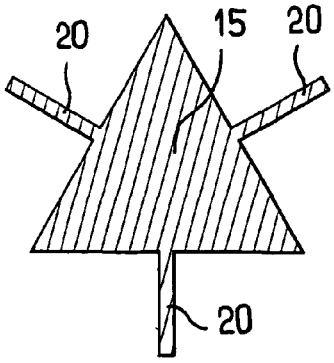

For example, in some exemplary embodiments, as shown in FIGS. 7 and 10, the applicator member may have at least one row 17 of projecting elements that may extend from at least one of the faces of the support (e.g., from a substantially middle region of the face).

In the exemplary embodiment shown in FIG. 7, the support 15 may present a substantially square cross-section having four faces, and the applicator member may have two rows 16*a*, 17 of projecting elements extending from at least one of the faces of the support 15 (e.g., from two opposite faces of the support 15). The row 17 may extend substantially perpendicular to the support 15. The row 16*b* may extend substantially in line with the extension of the face from which the row 17 may extend. Thus, the row 16*b* may extend substantially perpendicular to the row 16*a*.

In the exemplary embodiment shown in FIGS. 1 to 4, about the longitudinal axis Y of the support 15, the applicator member may present two alternating rows 16, 17, 18, 19: one row 16, 18 having at least three consecutive projecting elements 20 that are regularly spaced apart at a first spacing e; and another row 17, 19 having at least three consecutive projecting elements 20 that are regularly spaced apart at a second spacing e', different from the first spacing e.

Figure 8:
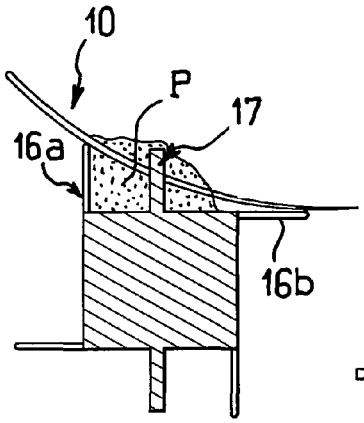

In the exemplary embodiment shown in FIGS. 7 and 8, the applicator member may present three alternating rows 16*a*, 17, 16*b* about the longitudinal axis Y of the support 15: two rows 16*a*, 16*b*, each presenting at least three consecutive projecting elements 20 that are regularly spaced apart at a first spacing; and one row 17 disposed between the two rows 16*a*, 16*b* and presenting at least three consecutive projecting elements 20 that are regularly spaced apart at a second spacing that may be greater than the first spacing.

The rows 16*a*, 17 of projecting elements 20 in the exemplary embodiment shown in FIGS. 7 and 8 may extend substantially in parallel with respect to each other. This configuration may make it possible for the applicator member to, for example, retain substance P in the space formed between the projecting elements 20 of the row 17 and the adjacent row 16*a*, as well as on the projecting elements 20 of the row 17, as shown in FIG. 8. Thus, a user may be able to apply a relatively large quantity of substance P to eyelashes or eyebrows while combing, separating, and/or lengthening them by using the projecting elements 20 of the row 16*a*.

The applicator member shown in FIGS. 7 and 8 may be manufactured by, for example, molding. For example, a mold comprising two or more separate mold pieces may be joined together, with a joining plane containing the rows 17, to form an internal space corresponding to the configuration of the applicator member. A suitable material for the applicator member may then be injected into the internal space of the mold. Once the material is sufficiently solidified, the two separate molding pieces may be moved apart in directions substantially opposite from one another, as represented by arrows F in FIG. 7. It should be understood that any other suitable manufacturing method known in the art may be used alternatively or additionally.

Figure 9:
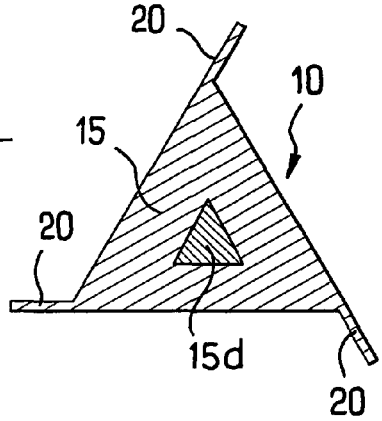
Figure 11:
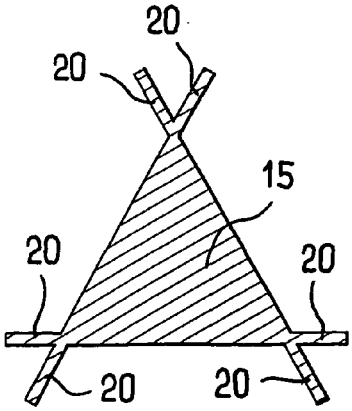
Figure 12:
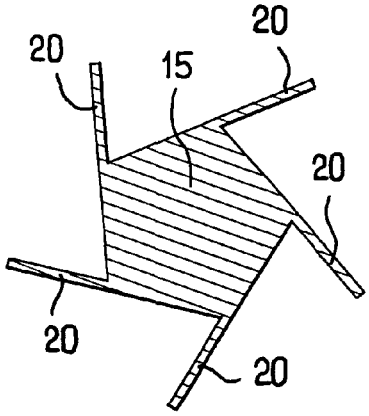
Figure 13:
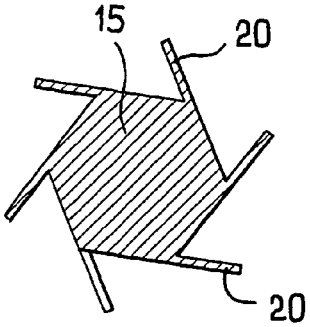
Figure 14:
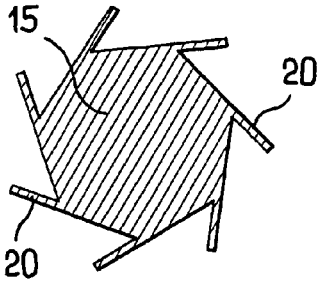
Figure 15:
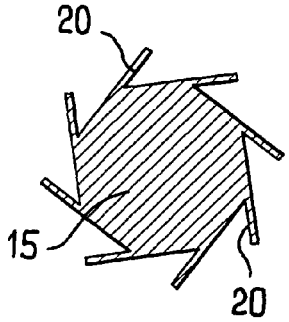

In various exemplary embodiments, the cross-sectional shape of the support 15 may not be substantially square. Instead, the support 15 may have any other polygonal shape. For example, the cross-sectional shape of the support 15 may be substantially triangular, as shown in FIGS. 9 to 11, substantially pentagonal, as shown in FIG. 12, substantially hexagonal, as shown in FIG. 13, heptagonal, as shown in FIG. 14, or substantially octagonal, as shown in FIG. 15. While the exemplary embodiments shown in FIGS. 9 to 15 illustrate cross-sectional shapes in regular polygons, it should be understood that the cross-sectional shapes may also be irregular polygons.

FIG. 9 shows the possibility of making the support 15 with a core 15*d* that may not be integrally formed as a single piece with the portion of the support 15 carrying the projecting elements 20. In an alternative embodiment, the core 15*d* may not be made of the portion of the same material as that of the support 15 carrying the projecting elements 20.

Figure 26:
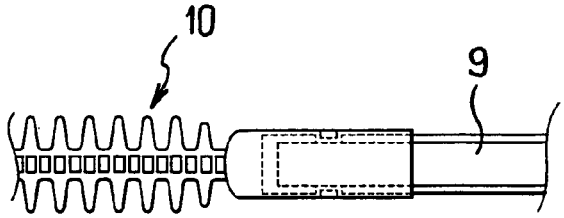
Figure 26A:
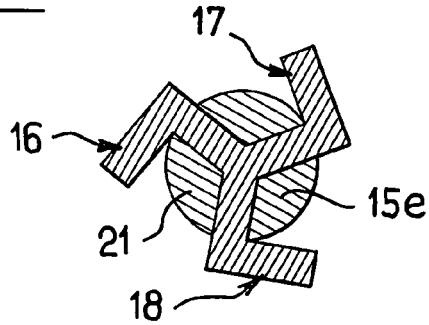
FIG. 26A is a diagrammatic, cross-sectional view of an applicator member, analogous to FIG. 4, illustrating another exemplary embodiment of an applicator member.

FIG. 26A shows the possibility of overmolding another portion 15*e* on the portion of the support from which the rows 16, 17, 18 of projecting elements may extend.

Figure 16:
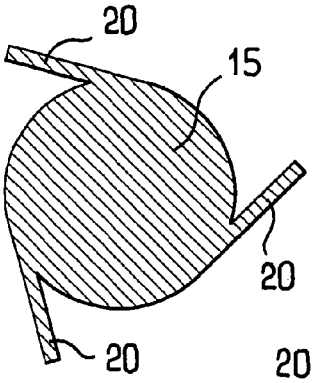
Figure 17:
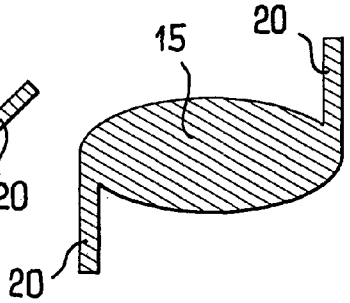

In some exemplary embodiments, the support may present a circular cross-sectional shape, as shown in FIG. 16, or an oval cross-sectional shape (e.g., elliptical shape), as shown in FIG. 17. In these exemplary embodiments, the projecting elements 20 may extend in directions that are substantially tangential to the surface of the support 15.

In the exemplary embodiments shown in FIGS. 9, 11 to 15, and 18, the rows of projecting elements 20 may extend substantially parallel to the corresponding faces of the support 15, such that each row of projecting elements 20 may extend tangentially with respect to the corresponding face of the support 15 and at an angle with respect to the adjacent face of the support 15.

Figure 18:
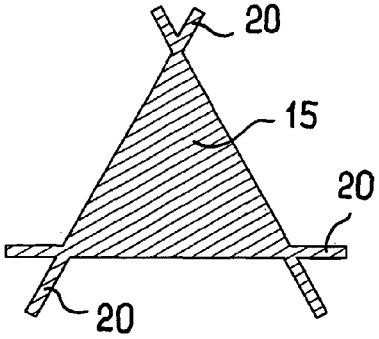

Each row of projecting elements 20 may extend from each face of the support 15, as shown in FIGS. 9 and 12 to 15. Alternatively, two rows of projecting elements 20 may extend from each face of the support 15, as shown in FIGS. 11 and 18. In some other exemplary embodiments, more then two rows of projecting elements 20 may extend from each face of the support 15. In still another exemplary embodiment, at least one face may not have any row of projection elements 20 extending therefrom.

As shown in FIG. 10, each row of projecting elements 20 may extend perpendicularly from each face of the support 15, substantially from a middle region of the corresponding face.

By way of example only, the height of the projecting elements 20, as measured from the support 15, may range from about 0.5 mm to about 10 mm, and in particular from about 1 mm to about 4 mm.

In at least some of the exemplary embodiments described above, the projecting elements 20 of the various rows may have the same height. It should be understood, however, that at least one projecting element 20 of one of the rows may have a height that is different from at least one projecting element 20 of another row, as shown in FIG. 18, or from at least one projection element 20 of the same row.

Figure 19:
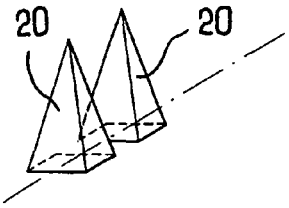
FIGS. 19 and 20 are schematic, perspective views of projecting elements, according to various exemplary embodiments of the invention, illustrating two exemplary arrangements of projecting elements.

The projecting elements 20 of at least one row may have their bases substantially in alignment with each other, as shown diagrammatically in FIG. 19. Alternatively or additionally, the projecting elements 20 of at least one row may be disposed at least partially on opposite sides of a geometrical separation plane substantially containing the longitudinal axis Y of the support 15, as shown in FIG. 20.

The term "geometrical separation plane," as used herein, refers to an imaginary geometric construction defining a boundary about which alternating projecting elements 20 may be disposed, at least partially, on either side thereof. An example of projecting elements 20 arranged with such a "geometrical separation plane" includes a plurality of projecting elements 20 disposed in a row with a geometrical separation plane passing through the mid-plane of the row, in which at least one of the projecting elements 20 is disposed on a first side of the geometrical separation plane while another of the projecting element 20 is disposed on a second side of the geometrical separation plane, opposite to the first side.

Figure 20:
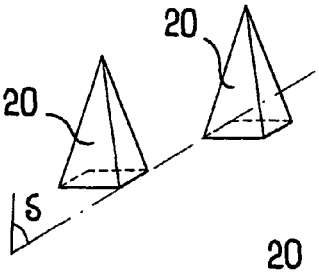

As shown in FIGS. 19 and 20, at least one projecting element 20 of at least one row may have a substantially pyramid shape. Alternatively, the projecting elements 20 may have any other suitable shape, such as, for example, a cylindrical shape, a frustoconical shape, a hook shape, a zigzag-shape, or any combination thereof.

In the exemplary embodiments described above, at least one row of projecting elements may comprise a plurality of individual, equally-spaced projecting elements that are successively arranged in the row. In a variant, the projecting elements in at least one row may be arranged successively in groups, where the groups may be regularly spaced apart from one another.

The spacing between two identical groups of projecting elements may be defined as, for example, the distance between two adjacent projecting elements that are each positioned in each of the two adjacent groups, where the distance is measured halfway up the projecting elements from the support.

Figure 21:
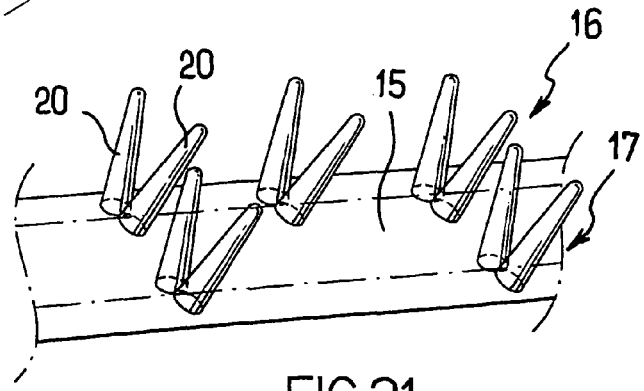
FIG. 21 is a partial, perspective view of an applicator member, according to another exemplary embodiment of the invention, illustrating groups of projecting elements arranged in at least one row.

FIG. 21 shows groups of projecting elements 20, where each group may comprise two projecting elements 20. The groups of projecting elements 20 in one row 16 may be regularly spaced apart at a spacing that is different from a spacing between the groups of projecting elements 20 in the adjacent row 17. The intervals over which the groups in the rows 16 and 17 repeat within any one row may be different.

The projecting elements 20 in at least one row 16, 17 may form at least one V-shaped groove or notch when the applicator member 10 is observed in a direction substantially perpendicular to the longitudinal axis Y of the support 15, as shown in FIG. 21. In this particular embodiment, at least two consecutive projecting elements 20 of the first row 16 may be touching each other, and/or at least two consecutive projecting elements 20 of the second row 17 may also be touching each other. In a variant, as shown in FIGS. 1 to 4, the consecutive projecting elements 20 of the first row 16 and those of the second row 17 may not be touching each other.

In the exemplary embodiments described above, none of the projecting elements may be internally hollow. In some exemplary embodiments, at least one of the projecting elements may be hollow.

The various exemplary embodiments of the applicator member described above may not have any bristles fitted to the support. It should be understood that, in some exemplary embodiments, the applicator member may include such bristles fitted to the support.

The support and the projecting elements may be made by, for example, injection-molding a plastic material (e.g., a thermoplastic elastomer). The plastic material may be selected, for example, from: polyolefins (e.g., polyethylene or polypropylene), polyamide, polyethylene terephthalate, polyoxymethylene, polystyrene, polycarbonate, Pebax®, styrene-ethylene/butylene-styrene (SEBS), polyurethane, nitrile, ethylene vinyl acetate (EVA), ethylene-propylene terpolymer rubber (EPDM), polyester, and Hytrel®.

Figure 22:
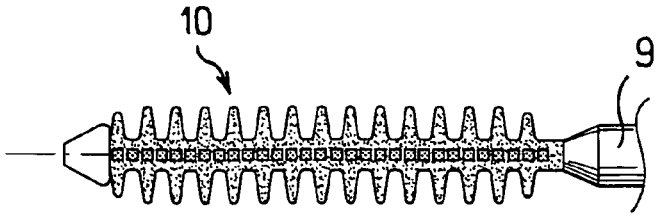
FIG. 22 is a diagrammatic, side view of an applicator member, analogous to FIG. 2, illustrating the possibility of incorporating a magnetic filler in the applicator member.

According to another exemplary embodiment, the support and/or at least one of the projecting elements may comprise magnetic properties. For example, the applicator member may include a filler of magnetic particles (e.g., magnetizable and/or magnetized material) dispersed in the material of the support and/or the projecting elements, as shown in FIG. 22.

Figure 23:
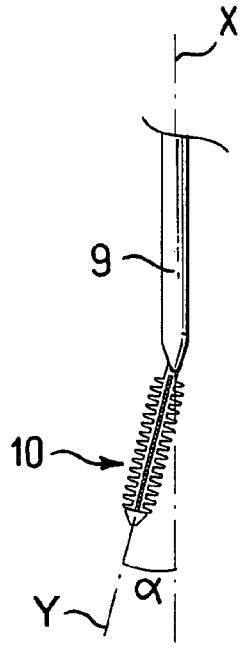
FIG. 23 is a diagrammatic, side view of an applicator, according to another exemplary embodiment of the invention, illustrating the possibility of having a non-zero angle between the longitudinal axis of the support and the axis of the stem.

The longitudinal axis X of the stem 9 and the longitudinal axis Y of the support 15 may coincide, as shown in the exemplary embodiments described above. Alternatively, as shown in FIG. 23, the longitudinal axis X of the stem 9 and the longitudinal axis Y of the support 15 may form a non-zero angle $\alpha$ therebetween. By way of example only, this angle $\alpha$ may extend up to 30°. In some exemplary embodiments, the angle $\alpha$ may range from about 1° to about 20°, and more particularly from about 2° to about 10°.

Figure 24:
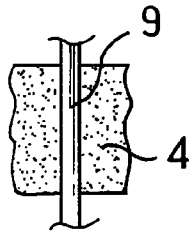
FIG. 24 is a partial plan view of a wiper member, according to an exemplary embodiment of the invention, illustrating the possibility of using a wiper member comprising a cellular material.

In the exemplary embodiment shown in FIG. 1, the wiper member 4 may be non-cellular and may comprise a flexible lip (e.g., made of elastomer or any other sufficiently flexible plastic material). In a variant, the wiper member 4 may comprise a cellular material, such as, for example, a block of foam, as shown in FIG. 24.

Figure 25:
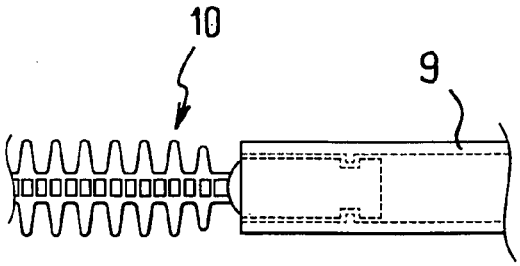
FIGS. 25 and 26 are diagrammatic, partial side views of an applicator, according to some exemplary embodiments of the invention, illustrating how the applicator member and the stem may be connected to each other.

The applicator member 10 may be integrally formed with the stem 9 by, for example, molding. Alternatively, the applicator member 10 may be fastened to the stem 9 by a suitable fastening mechanism. For example, the stem 9 may define a housing at its one end, and the applicator member 10 may be force-fitted into or snap-fastened to the housing, as shown in FIG. 25. In a variant, the applicator member 10 may define a housing to which the stem 9 may be fastened, as shown in FIG. 26. Any other suitable fastening mechanisms (e.g., welding, gluing, screw-fastening, etc.) may be used alternatively or additionally.

Figure 27:
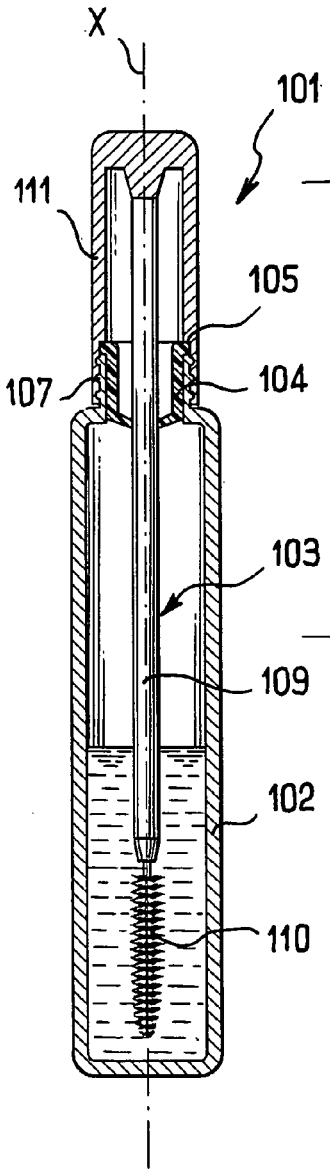
FIG. 27 is a diagrammatic, axial cross-sectional view of a packaging and applicator device, according to another exemplary embodiment of the invention.

FIG. 27 shows a packaging and applicator device 101 for applying a substance, according to another exemplary embodiment of the invention. The device 101 may comprise a receptacle 102 having a neck 107, an applicator 103 (e.g., brush), and a wiper member 104. The wiper member 104 may include a collar 105 that may press against the neck 107 of the receptacle 102.

The applicator 103 may comprise a stem 109 having a longitudinal axis X, which may be provided with an applicator member 110 at a first end and a handle member 111 at a second end. The handle member 11 may also constitute a closure cap for the receptacle 102.

The applicator member 110, shown in greater detail in FIGS. 28 to 31, may comprise a support 115 having a longitudinal axis Y that may be rectilinear. In some exemplary embodiments, the support 115 may comprise a metal wire folded in half and twisted. The support 115 may be inserted, by force, into a housing defined in the stem 109.

The applicator member 110 may include bristles 112 extending from the support 115. These bristles 112 may be held by clamping in one or more openings of the support 115 formed by, for example, twisting the support 15.

Figure 30:
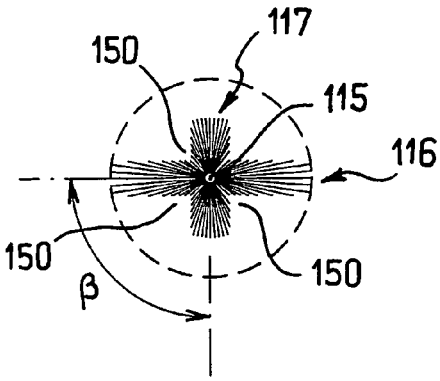
FIGS. 30 and 31 are cross-sectional views of the applicator member shown in FIG. 29 along the XXX-XXX plane and XXXI-XXXI plane, respectively.

The bristles 112 may extend along four rows: first row 116, second row 117, third row 118, and fourth row 119. The rows 116, 117, 118, 119 of bristles 112 may be disjoint from each other and may present a radial spacing $\beta$ of about 90°, for example, as shown in FIG. 30. Thus, the rows 116, 117, 118, 119 of bristles 112 may form longitudinal grooves 150 therebetween, which may extend along the longitudinal axis Y of the support 115, as shown in FIGS. 30, 31, 33, 34, and 36-38.

Figure 28:
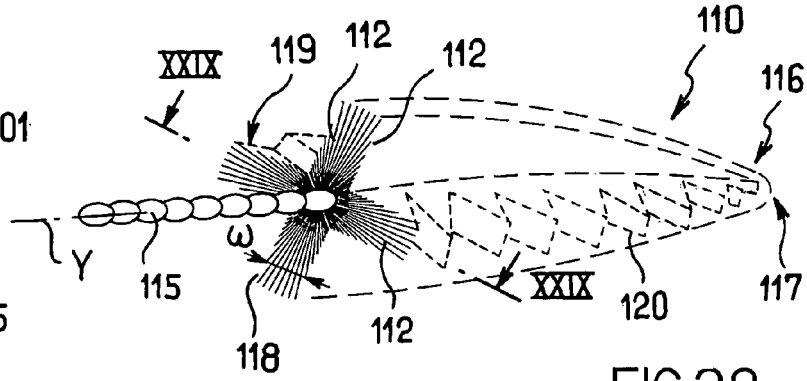
FIG. 28 is a partial, perspective view of the device shown in FIG. 27, according to another exemplary embodiment of the invention.
Figure 29:
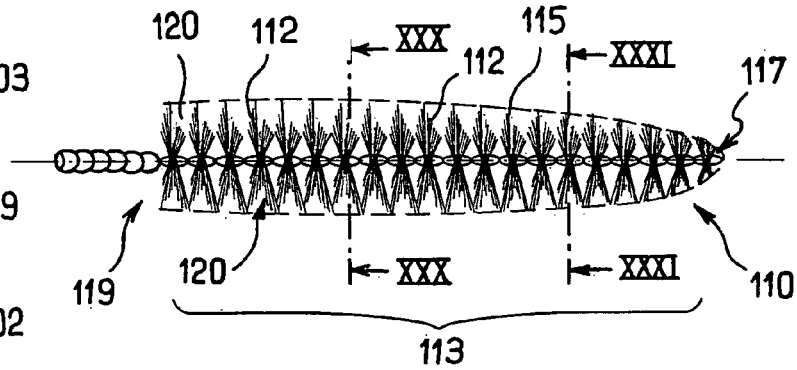
FIG. 29 is a diagrammatic, cross-sectional view of the applicator shown in FIG. 28 along the XXIX-XXIX plane.

In the exemplary embodiment shown in FIGS. 28 and 29, the first and third rows 116, 118 may be identical to each other and may be positioned opposite from each other with respect to the support 115. The same may apply to the second and fourth rows 117, 119. The first row 116 and the second row 117 may have shapes that are different from one another.

By way of example only, the rows 116, 117, 118, 119 may extend over more than half the length of the bristle-carrying portion 113 of the support 115.

At least one of the rows (e.g., the second and fourth rows 117, 119 in the exemplary embodiments shown in FIGS. 28 and 29) may include at least one notch 120 when the applicator member 110 is observed in a direction substantially perpendicular to the longitudinal axis Y of the support 115.

In the exemplary embodiment shown in FIGS. 28 and 29, the second and fourth rows 117, 119 may have a plurality of notches 120. By way of examples only, each of the second and fourth rows 117, 119 may have more than five notches. In some particular embodiments, the number of notches may range from about 5 notches to about 20 notches in a given row. These notches 120 may be substantially equidistant (e.g., regularly spaced apart) from one another, and the row having the notches 120 may present a crenellated profile along the longitudinal axis Y of the support 115.

The first rows 116 and the third row 118 may not include any notches, such that the applicator member 110 may comprise an alternation of notch-free rows 116, 118 and notched rows 117, 119, as shown in FIG. 28.

Figure 32:
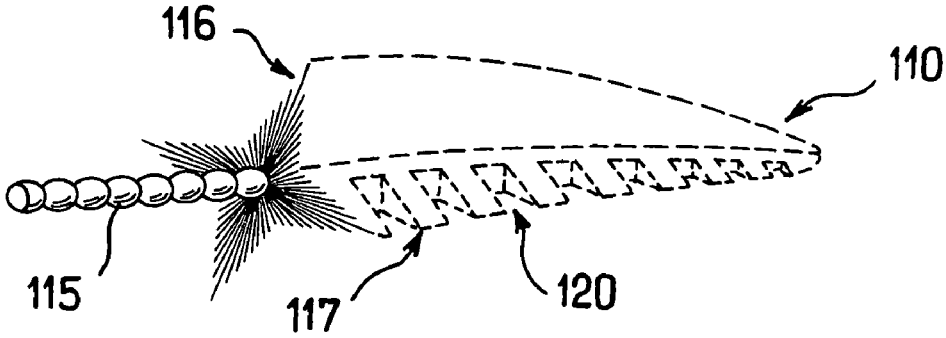
FIG. 32 is a partial, perspective view of an applicator member, analogous to FIG. 28, according to another exemplary embodiment of the invention.

The notches 120 may have the same or different profiles within a given row. The notches 120 may have a variety of different shapes. For example, each notch 120 may have a substantially V-shaped profile when the row is observed in a direction substantially perpendicular to the longitudinal axis Y of the support 115. In some exemplary embodiments, the notch 120 may have a substantially U-shaped profile, as shown in FIG. 32.

In the exemplary embodiment shown in FIGS. 28 to 31, the depth of a notch 120 may be substantially equal to the length of the bristles 112. In an alternative embodiment, the depth of a notch 120 may be less than the length of the bristles 112. In this case, the bottom of the notch 120 may be defined by the ends of shorter bristles 112.

Figure 31:
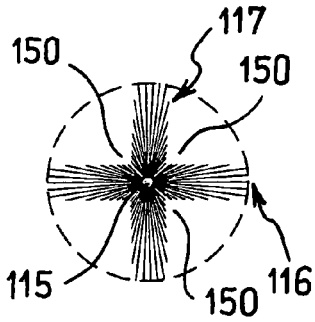

As shown in FIG. 28, at least one of the rows 116, 117, 118, 119 may have a width $\omega$. The width $\omega$ may be substantially constant along at least a fraction of the length of the row when the applicator member 110 is observed along the longitudinal axis Y of the support 115. The cross-section of the applicator member 110 may form a cross, as shown in FIGS. 30 and 31, where the four rows 116, 117, 118, 119 and four grooves 150 between the rows may form crenellations. As shown in FIG. 30, the length of the bristles 112 in at least one of the rows 116, 117, 118, 119 may be different from that of the bristles 112 in at least one of the other rows. Alternatively, as shown in FIG. 31, the length of the bristles 112 in all the rows 116, 117, 118, 119 may be substantially the same. In another exemplary embodiment, the width ω of at least one of the rows 116, 117, 118, 119 may not be substantially constant along its length.

The width ω of the rows 117, 119 including notches 120 may be sufficient to give the rows 117, 119 a certain degree of rigidity. Adequate rigidity of the rows 117, 119 of bristles 112 may allow the substance to remain in the notches 120 during, for example, wiping.

According to another exemplary embodiment, at least one of the rows 116, 117 may have a substantially triangular cross-sectional shape. For example, as shown in FIGS. 32 and 33, at least one of the rows 116, 117 may have, over at least a fraction of its length, a width ω that may decrease along its radially outward direction when the applicator member 110 is observed along the longitudinal axis Y of the support 115.

Figure 35:
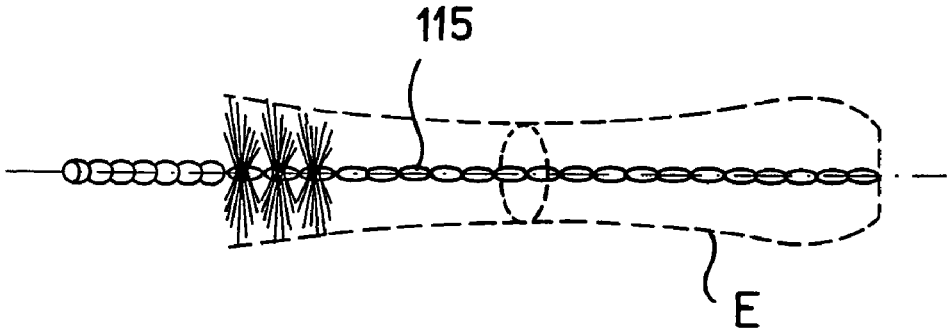
FIG. 35 is a diagrammatic, cross-sectional view of an applicator, according to another exemplary embodiment of the invention, illustrating an exemplary envelope surface of an applicator member.

In the exemplary embodiment shown in FIGS. 32 and 33, the envelope surface E of the applicator member 110 may have a shape that is generally tapering towards the distal end of the applicator member 110. In some exemplary embodiments, the cross-section of the envelope surface E of the applicator member 110 may have a minimum cross-sectional area between the ends of the support 115, as shown in FIG. 35. In a variant, the applicator member 110 may have more than one region in which the envelope surface E has the minimum cross-sectional area.

For at least a fraction of the length of the applicator member 110, the envelope surface E may have a circular cross-section, as shown in FIG. 33. In an alternative embodiment, for at least a fraction of the length of the applicator member 110, the envelope surface E may have a polygonal (e.g., either regular or irregular) cross-section, such as, for example, a square cross-section, as shown in in FIG. 34.

When the envelope surface E of an applicator member 110 has a polygonal cross-section, the applicator member 110 may be made from a cylindrical blank by cutting it in such a way that its cross-sectional shape may have a polygonal shape. Thereafter, the applicator member 110 may be trimmed so as to present a desired cross-sectional shape (e.g., a star-shaped cross-section). The notches 120 may be formed by machining the applicator member 110 after the rows 116, 117 have been formed, for example. The rows 116, 117 may be made by forming longitudinal grooves 150 in the applicator member 110.

The rows 116, 117 may be disjoint from each other (e.g., not touch each other) down to the support 115 (e.g., core) of the applicator member 110. Alternatively, the rows 116, 117 may join one another at a region other than the support 115 (e.g., along a portion of their lengths).

Various exemplary embodiments of the applicator members 10, 110 made in accordance with the invention, including those described above with reference to FIGS. 27 to 31, may be used to apply substance to, for example, eyelashes or eyebrows by bringing the eyelashes and eyebrows into contact with at least one of the rows having notches. Thereafter, a row having no notches may be used to separate and/or comb the eyelashes or eyebrows. The row having no notches may be brought into contact with the eyelashes or eyebrows by, for example, turning the applicator member 110 about its longitudinal axis Y. By way of example only, the applicator member 110 may be turned less than 140° or 135°. This angle may vary depending on, for example, the configuration of the applicator member 110.

FIGS. 36 to 38 illustrate various other exemplary embodiments of an applicator member. In the exemplary embodiment shown in FIG. 36, the applicator member may have three rows 116, 117, 118 of projecting elements (e.g., bristles or teeth). The rows 116, 117, 118 may have an angular spacing β of about 120° between two adjacent rows. In this particular embodiment, only the row 117 may have at least one notch. In a variant, only the row 116 may be notch-free. Of course, any other arrangement of rows with or without notches may be possible.

In the exemplary embodiment shown in FIG. 37, the applicator member may have four rows 116, 117. Two diametrically-opposite rows may include notches, while the other two rows may be notch-free.

The exemplary embodiments shown in FIGS. 36 and 37 shows that the width of each row may increase in the radially outward direction from the support 115 (e.g., core).

The applicator member shown in FIG. 38 may include four rows 116, 117, 118, 119 of bristles that may have been machined from a blank having, for example, a square cross-section. Each row 116, 117, 118, 119 of bristles may form a channel 150 (e.g., longitudinal groove) with a face 152 of the adjacent row 116, 117, 118, 119 of bristles when the applicator member is observed in a cross-section substantially perpendicular to the longitudinal axis of the support 115, as shown in FIG. 38.

In at least some of the exemplary applicator members described above, the screw-thread or turn effect (i.e., ends of the bristles extending in a substantially helical arrangement, impeding penetration of eyelashes between bristles) associated with the twisted support may be attenuated or even eliminated by, for example, selecting bristles having a cross-section that is not circular (e.g., bristles with hinges or bristles that are hollow) or bristles that have been deformed by subjecting the bristles to one or more mechanical treatments after the applicator member has been initially made. Such treatments may include deforming the bristles as described in European Patent Application Publication No. EP 1 459 647 (i.e., corresponding to U.S. patent application Publication No. 2004/0240926, the disclosure of which is incorporated herein by reference). For example, at at least one point along the length of the bristle, the bristle may include a portion from which the bristle material has been removed. The portion may have been stretched or flattened. The bristles may cease to extend outwardly in a radial direction from that point of deformation.

The invention is not limited to the exemplary embodiments described above. In particular, the characteristics and/or features of the various exemplary embodiments, particularly relating to the applicator members (e.g., combs or brushes), may be combined.

For example, FIGS. 39 to 42 show other various exemplary embodiments that may enable various make-up effects (e.g., heavy makeup) of the eyelashes or eyebrows while simultaneously enabling the applicator member to separate the eyelashes or eyebrows.

As shown in the exemplary embodiment of FIG. 39, the applicator member 200 may not have longitudinal grooves separating rows of bristles. Instead, the applicator member 200 may comprise one or more first regions 201 having notches 203 and one or more second regions 202 that may be free from any notches. The first and second regions 201, 202 may extend along the longitudinal axis of the applicator member 200. The first regions 201 may include packets 204 of bristles between the notches 203, and the spacing between these packets 204 of bristles may be uniform along the support 115.

The first regions 201 may be filled with a larger quantity of substance due to, for example, the presence of the notches 203. The second regions 202 may be used for separating the eyelashes or eyebrows.

In the exemplary embodiments shown in FIG. 39, the notches 203 of one of the first regions 201 may occupy substantially the same axial position along the longitudinal axis of the applicator member as the notches 203 of the other first region 201.

The notch-free, second region 202 may extend, for example, over an angular sector γ about the longitudinal axis of the support 115. By way of example only, the angular sector γ may be greater than or equal to 30° or 45°.

In some exemplary embodiments, the applicator member 200 may include two first regions 201 that may be positioned diametrically-opposite from one another, as shown in FIG. 40. Moreover, the notches 203 may be machined to have flat bottoms, as also shown in FIG. 40.

While the envelope surface of the applicator member 200 shown in FIG. 39 has a circular cross-sectional shape, the envelope surface may have a variety of different cross-sectional shapes. For example, the applicator member 200 may have a substantially polygonal envelope surface, such as, for example, a substantially triangular cross-sectional shape, as shown in FIG. 41. A succession of notches 203 may be formed along a ridge to define the first region 201 to be filled with a quantity of substance. The bottoms 210 of the notches 203 may be substantially parallel to the base of the triangle, as shown in FIG. 41.

In the exemplary embodiment shown in FIG. 42, the envelope surface may have a substantially square cross-section, and the notches 203 may be formed along two diametrically-opposite edges. The bottoms 210 of the notches 203 may be substantially parallel to the diagonal of the square.

Throughout the description, including in the claims, the term "comprising a" should be understood as being synonymous with the term "comprising at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. An applicator for applying a substance to eyelashes and/or eyebrows, the applicator comprising:

an applicator member comprising a support having a longitudinal axis;

a first row of projecting elements extending along the support; and a second row of projecting elements extending along the support, wherein at least one of the projecting elements of the first row extends in a direction different from a direction in which at least one of the projecting elements of the second row extends;

wherein a radial angular spacing about the longitudinal axis of the support between the first row of projecting elements and the second row of projecting elements is greater than zero and less than or equal to about 135°, wherein the projecting elements of the first row are distributed in a uniform manner along said first row, and the projecting elements of the second row are distributed in a uniform manner along said second row, wherein, when said elements are part of an integral, single piece defining at least a portion of the support, the projecting elements of the first and second rows are distributed differently such that at least three consecutive projecting elements of the first row have a first spacing from each other, and at least three consecutive projecting elements of the second row have a second spacing from each other, the second spacing being different from the first spacing, the first spacing being smaller than the second spacing, wherein a center of a base of at least one projecting element of the first row occupies the same axial position, along the longitudinal axis of the support, as a center of a base of at least one projecting element of the second row, and wherein each of the projecting elements of the first and second rows is either a tuft of bristles or a single tooth.

2. A device for applying a substance to eyelashes and/or the eyebrows, comprising:

a receptacle containing the substance; and the applicator of claim 1.

3. A device according to claim 2, further comprising a stem extending along a longitudinal axis and having a first end connected to the applicator member, wherein the longitudinal axis of the stem coincides with the longitudinal axis of the support.

4. A device according to claim 2, further comprising a stem extending along a longitudinal axis and having a first end connected to the applicator member, wherein the longitudinal axis of the stem and the longitudinal axis of the support form a non-zero angle therebetween.

5. A device according to claim 2, further comprising a wiper member.

6. A device according to claim 2, wherein the substance comprises a mascara.

7. An applicator for applying a substance to eyelashes and/or eyebrows, the applicator comprising:

an applicator member comprising a support having a longitudinal axis; and at least first, second, and third rows of projecting elements integral with at least a portion of the support, at least the first and second rows each having at least three consecutive projecting elements, wherein at least one of the projecting elements of the first row extends in a direction different from a direction in which at least one of the projecting elements of the second row extends, wherein the three consecutive projecting elements of the first row are regularly spaced apart from each other by a first spacing, wherein the three consecutive projecting elements of the second row are regularly spaced apart from each other by a second spacing different from the first spacing, the first spacing being smaller than the second spacing, wherein a center of a base of at least one projecting element of the first row occupies the same axial position, along the longitudinal axis of the support, as a center of a base of at least one projecting element of the second row, and wherein each of the projecting elements of each row is either a tuft of bristles or a single tooth.

8. An applicator according to claim 7, wherein the second spacing is a multiple of the first spacing.

9. An applicator according to claim 7, wherein the second spacing ranges from about 1.5 to about 5 times the first spacing.

10. An applicator according to claim 7, wherein the first and second rows are sufficiently close together to enable at least a fraction of their projecting elements to come into contact with eyelashes or eyebrows during a single application stroke.

11. An applicator according to claim 7, wherein at least one projecting element of the first row extends in a first direction, at least one projecting element in the second row extends in a second direction, and the first and second directions form between them an angle that is less than or equal to about 180°, 140°, 135°, 120°, 110°, or 90°.

12. An applicator according to claim 7, wherein the applicator has at least four rows of projecting elements.

13. An applicator according to claim 7, wherein the first row of projecting elements is disposed on a first face of the support, wherein the second row of projecting elements is disposed on a second face of the support, and wherein the third row of projecting elements is disposed on a third face of the support.

14. An applicator according to claim 7, where the at least first, second, and third rows of projecting elements comprise at least two alternating rows, one of the at least two alternating rows having at least three consecutive projecting elements or groups of projecting elements that are regularly spaced apart from each other by a first spacing, and another of the at least two alternating rows having at least three consecutive projecting elements or groups of projecting elements that are regularly spaced apart from each other by a second spacing, different from the first spacing.

15. An applicator according to claim 7, wherein the support and the projecting elements are molded from a plastics material.

16. A device for applying a substance to eyelashes and/or the eyebrows, comprising:

a receptacle containing the substance; and the applicator of claim 7.

17. A device according to claim 16, further comprising a stem extending along a longitudinal axis and having a first end connected to the applicator member.

18. A device according to claim 17, wherein the longitudinal axis of the stem coincides with the longitudinal axis of the support.

19. A device according to claim 17, wherein the longitudinal axis of the stem and the longitudinal axis of the support form a non-zero angle therebetween.

20. A device according to claim 17, wherein the stem has a second end connected to a handle member.

21. A device according to claim 20, wherein the handle member constitutes a closure cap for the receptacle.

22. A device according to claim 16, further comprising a wiper member.

23. A device according to claim 16, wherein the substance comprises a mascara.

24. An applicator for applying a substance to eyelashes and/or eyebrows, the applicator comprising:

an applicator member comprising a support having a longitudinal axis;

a first row of projecting elements extending along the support; and a second row of projecting elements extending along the support, wherein at least one of the projecting elements of the first row extends in a direction different from a direction in which at least one of the projecting elements of the second row extends;

wherein a radial angular spacing about the longitudinal axis of the support between the first row of projecting elements and the second row of projecting elements is greater than zero and less than or equal to about 135°, wherein the projecting elements of the first row are distributed in a uniform manner along said first row, and the projecting elements of the second row are distributed in a uniform manner along said second row, wherein, when said elements are part of an integral, single piece defining at least a portion of the support, the projecting elements of the first and second rows are distributed differently such that at least three consecutive projecting elements of the first row have a first spacing from each other, and at least three consecutive projecting elements of the second row have a second spacing from each other, the second spacing being different from the first spacing, the first spacing being smaller than the second spacing, wherein a center of a base of at least one projecting element of the first row occupies the same axial position, along the longitudinal axis of the support, as a center of a base of at least one projecting element of the second row, and wherein each of the projecting elements of the first and second rows is either a tuft of bristles, a single tooth, or two teeth extending from a single base in a plane perpendicular to the longitudinal axis of the support.

* * * * *